United States Patent [19]

Nagano

[11] Patent Number: 4,536,702

[45] Date of Patent: Aug. 20, 1985

[54] CONSTANT CURRENT SOURCE OR VOLTAGE SOURCE TRANSISTOR CIRCUIT

[75] Inventor: Katsumi Nagano, Shimonoseki, Japan

[73] Assignee: Tokyo Shibaura Denki Kabushiki Kaisha, Japan

[21] Appl. No.: 482,162

[22] Filed: Apr. 5, 1983

[30] Foreign Application Priority Data

Apr. 5, 1982 [JP] Japan ..... 57-55303

[51] Int. Cl.[3] ..... G05F 3/20

[52] U.S. Cl. ..... 323/316; 323/314

[58] Field of Search ..... 323/312, 3131, 314, 323/315, 316, 317; 307/296 R, 297

[56] References Cited

U.S. PATENT DOCUMENTS

| | | | |
|---|---|---|---|
| 3,648,153 | 3/1972 | Graf | 323/313 |
| 4,030,023 | 6/1977 | Keith | 323/313 |
| 4,221,979 | 9/1980 | Ahmed | 323/313 |
| 4,325,017 | 4/1982 | Schade, Jr. | 323/313 |

FOREIGN PATENT DOCUMENTS

| | | |
|---|---|---|
| 3023119 | 6/1980 | Fed. Rep. of Germany . |
| 1453439 | 8/1965 | France . |
| 2007055 | 10/1976 | United Kingdom . |
| 2010623 | 12/1978 | United Kingdom . |
| 2030810 | 8/1979 | United Kingdom . |

OTHER PUBLICATIONS

Gray et al., "Analysis and Design of Analog Integrated Circuits", p. 263.

*Primary Examiner*—Peter S. Wong
*Assistant Examiner*—Judson M. Jones
*Attorney, Agent, or Firm*—Finnegan, Henderson, Farabow, Garrett & Dunner

[57] ABSTRACT

According to this invention, a transistor circuit is disclosed which comprises two main circuit portions connected in parallel between a power supply terminal and a reference voltage terminal. They are responsive to the power supply voltage to generate first and second currents respectively when the power supply voltage exceeds predetermined first and second voltage levels respectively. A circuit portion is also provided for producing a constant current equivalent to the difference of said first and second currents.

4 Claims, 26 Drawing Figures

CONSTANT CURRENT SOURCE OR VOLTAGE SOURCE TRANSISTOR CIRCUIT

BACKGROUND OF THE INVENTION

This concerns a transistor circuit. In particular, it concerns a transistor circuit which provides a constant-current source circuit which can operate with a low power source voltage threshold and is minimally dependent on its electric power source, and a constant-voltage circuit which makes use of these properties of the constant-current circuit.

In recent years, with the miniaturization of portable audio equipment, cameras, etc., the demand has increased for constant-current and constant-voltage circuits which are unaffected, even at low voltages, by variations in power source voltage, temperature, etc.

Various type of constant-current and constant-voltage circuits have been proposed before. The present invention aims to meet the demand referred to above by improving on such circuits. An explanation is given first of the prior art.

FIG. 1(A) is a constant-current source which makes use of a current mirror circuit. The two emitters, and the two bases, of the two NPN type transistors 1 and 2 are respectively connected in common. The emitters are connected to the first power supply terminal G. The collector and base of the transistor 1 are connected together, and via the resistor 3 are connected to the second power supply terminal $V_{CC}$. Since the voltage $V_{BE}$ between the base and emitter of each of the transistors 1 and 2 is the same, the collector currents of the two transistors will be equal if their structural dimensions are the same; and consequently the output current $I_{out}$ can be expressed as follows $$I_{out} = \frac{V_{CC} - V_{BE}}{R} \quad (1)$$

where R is the resistance of the resistor 3 and $V_{CC}$ the voltage at terminal $V_{CC}$.

Since however the output current $I_{out}$ depends on the voltage $V_{CC}$ of the power supply, the properties of the circuit are less than satisfactory, as is shown by FIG. 1(B).

FIG. 2 shows examples of conventional circuits which have been improved by reducing the effect of the power supply on the current values. If the structural dimensions of the transistors 21, 22 and 23, and 26 and 27 in the layout of the circuits shown in FIGS. 2(A) and (B) are all made equal, a voltage equal to the voltage $V_{BE}$ between the base and emitter of the transistors will be produced at the resistors 24 and 28 shown in the circuits. Consequently, if the base-common-current amplification factor $\alpha$ of each of the transistors 22 and 27 is taken as being 1, the output current $I_{out}$ is expressed in each case by $$I_{out} = V_{BE}/R \quad (2)$$

where R is the resistance of the resistors 24 and 28.

As formula (2) shows, in a current source circuit of this type the output current $I_{out}$ does not depend on the voltage $V_{CC}$ of the power supply. However, such circuits will not operate unless the base potential of the respective transistors 22 or 27 is at least twice the voltage $V_{BE}$ between base and emitter. Their operating properties are shown in FIG. 2(*c*), and there is no output current $I_{out}$ until $V_{CC}$ exceeds 1.4 V.

FIG. 2(D) is an example of a current mode logic (CML) circuit using the circuit illustrated in FIG. 2(A) as its current source. The common emitters of the two transistors 30-1 and 30-2 are connected to the collector of the transistor 22; the collector of each of the transistors 30-1 and 30-2 is connected, via the resistors 30-3 and 30-4, to the power supply terminal $V_{CC}$. One of the transistors 30-1 and 30-2 turns ON as a result of the relationship between the electric potentials of the inputs applied to the respective bases of the two transistors; and the output is obtained via the resistor 30-3 or the resistor 30-4. This circuit will not operate unless at least the electric potential of the collector of the transistor 21 is more than $2V_{BE}$, i.e. at least approximately 1.4 V; and this means that the electric potential of the collector of the transistor 22 must also be at least 1.4 V. Further, for the logic circuit to respond to the inputs applied to the bases of the transistors 30-1 and 30-2, a voltage applied to these bases must be at least $V_{BE}$ (i.e. 0.7 V) added to 1.4 V.

Thus a voltage of at least 2.1 V must be applied to the collectors of transistors 30-1 and 30-2. Therefore the power supply voltage must be at least 2.1 V.

FIG. 3 shows a conventional circuit which has been improved to reduce the threshold voltage of a constant-current source circuit. The transistor 31 is biased by the series circuit of resistors 33 and 34 connected between the base of the transistor 32 and the power supply terminal G. We can assume that the relation between the resistances $R_{33}$ and $R_{34}$ of the resistors 33 and 34 is set at $$R_{34} = k \cdot R_{33} \quad (3).$$

Then, if the voltage drop across $R_{33}$ is greater than the base-emitter voltage $V_{BE}$ of the transistor, i.e. at least approximately 0.7 V, the transistor 31 will be in a conducting state. Since the base-emitter voltage $V_{BE}$ of the transistor 31 is kept constant at approximately 0.7 V even though the power supply voltage $V_{CC}$ may be larger the base potential of the transistor 32 is also kept constant at $(1+k) \cdot V_{BE}$.

Consequently, since the voltage drop occurring across the resistor 35 connected between the emitter of the transistor 32 and the power supply terminal G is $k \cdot V_{BE}$, the collector current of the transistor 32, or in other words the output current $I_{out}$, can be expressed as follows $$I_{out} = k \cdot V_{BE}/R_{35} \quad (4)$$

where $R_{35}$ is the resistance of the resistor 35. But this type of circuit will not operate unless the power supply voltage $V_{CC}$ is more than $(1+k)V_{BE}$, as shown in FIG. 3(B).

SUMMARY OF THE INVENTION

Accordingly, an object of the present invention is to provide a transistor circuit which will operate at a low voltage, and which will supply constant current or constant voltage which does not depend on the voltage of the power source.

To achieve the above object, a transistor circuit has a first terminal responsive to a power supply voltage, and a second terminal connected to a reference voltage. First and second circuit portions are connected in parallel between these terminals. The first and second circuit portions are responsive to the supply voltage to cause respective first and second currents, which are proportional to the power supply voltage, when the power supply voltage exceeds first and second predetermined voltage levels respectively.

Circuit means is connected to the first and second circuit portions for producing a differential current of the first and second currents. The differential current is a constant-current. A constant-voltage can be obtained by using the constant-current.

BRIEF DESCRIPTION OF THE DRAWINGS

Other objects and advantages of the invention will be apparent from the following description taken in connection with the accompanying drawings, in which.

DETAILED DESCRIPTION OF THE PREFERRED EMBODIMENTS

Some preferred embodiments of the invention are explained below with reference to the drawings.

Figure 4A:
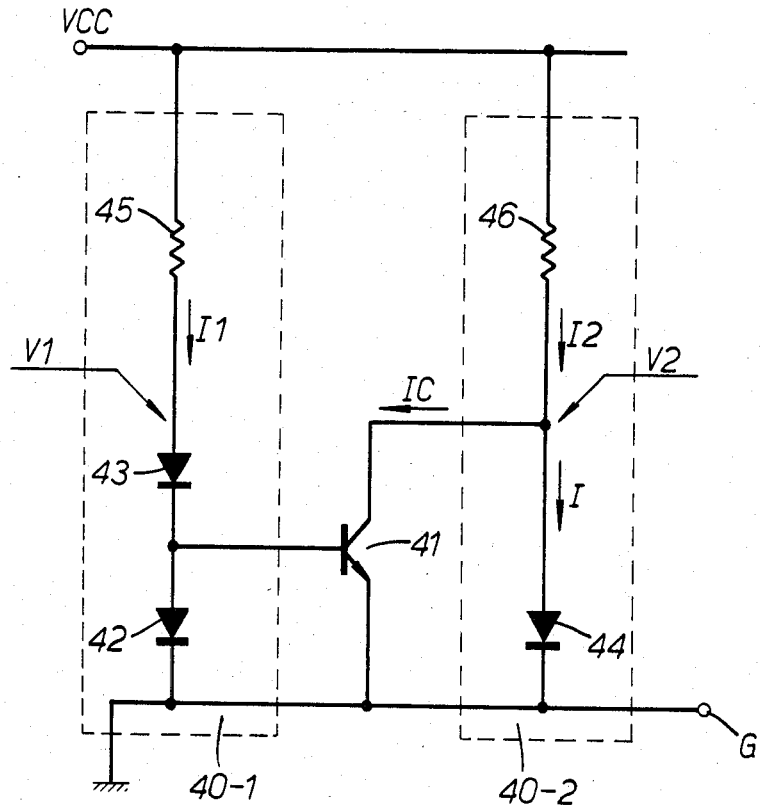
FIG. 4(A) is a circuit diagram of a first preferred embodiment of a transistor circuit according to the present invention.
Figure 4:
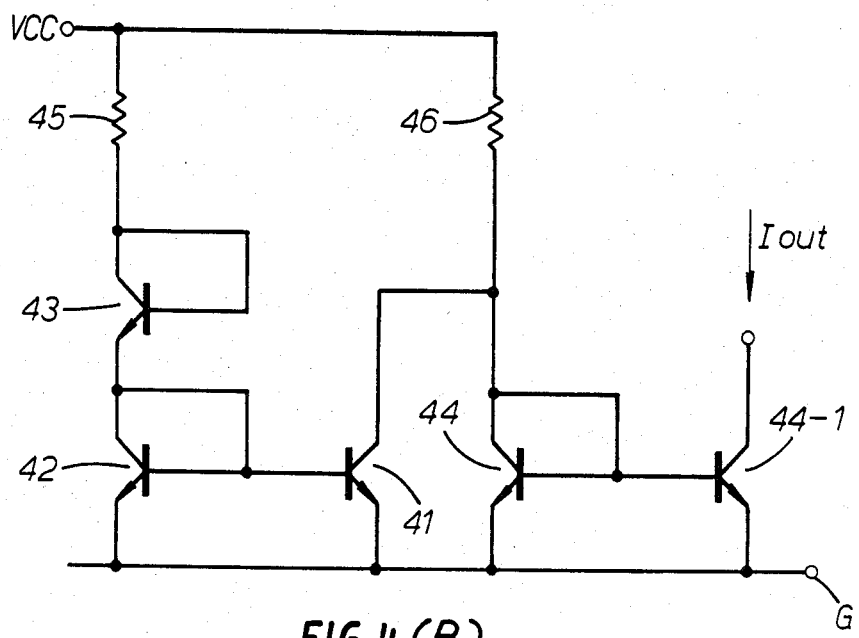
FIG. 4(B) is a circuit diagram of a second preferred embodiment of a transistor circuit according to the present invention and FIG. 4(C) shows the voltage-currrent characteristic of the transistor circuits illustrated in FIGS. 4(A) and (B).
FIGS. 4(D) and (E) are circuit diagrams of additional third and fourth embodiments of transistor circuits according to the present invention.
Figure 4:
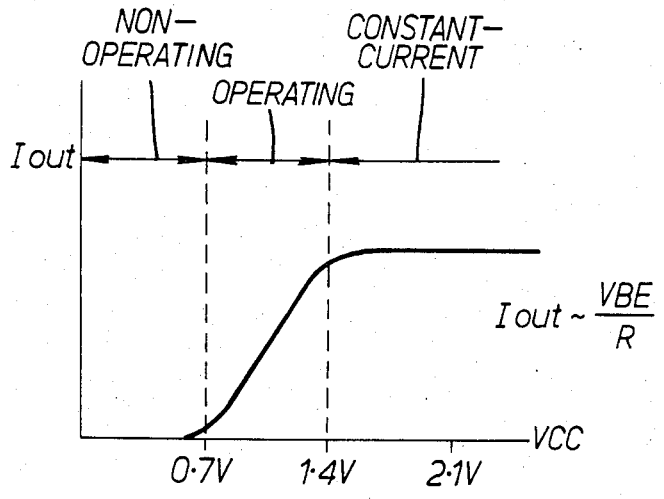
Figure 4:
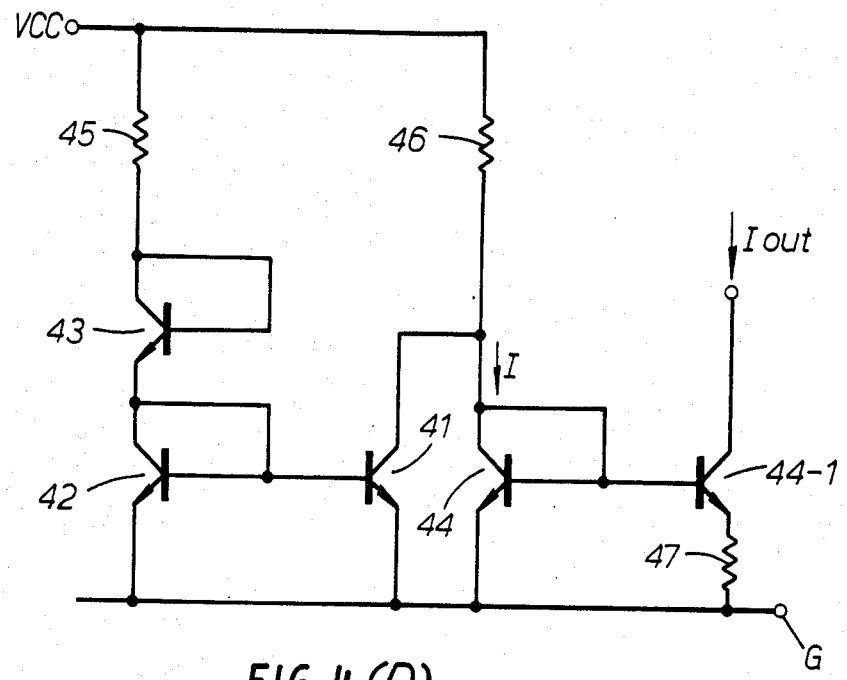

FIG. 4(A) is a circuit diagram showing the basic layout of the transistor circuit of this invention.

In a first circuit portion 40-1 a current flows which is a function of the power supply voltage $V_{CC}$ when the latter is greater than a first voltage $V_1$.

Circuit portion 40-1 is a series circuit consisting of the resistor 45 and the diodes 42 and 43, connected between the power supply terminal $V_{CC}$ and ground terminal G. The current $I_1$ flowing through this first circuit can therefore be expressed as $$I_1 = \frac{V_{CC} - 2V_F}{R_{45}} \tag{5}$$

where $V_F$ is the forward direction voltage of the diodes, and $R_{45}$ is the resistance of the resistor 45.

In a second circuit portion 40-2 a current flows which is a function of the power supply voltage $V_{CC}$ when the latter is greater than a second voltage $V_2$. Circuit portion 40-2 consists of the resistor 46 and the diode 44 connected in series between the first power supply terminal $V_{CC}$ and the second power supply terminal G. The current $I_2$ through resistor 46 in the second circuit portion can be expressed as $$I_2 = \frac{V_{CC} - V_F}{R_{46}} \tag{6}$$

where $V_F$ is the forward direction voltage of the diode 44, and $R_{46}$ is the resistance of the resistor 46.

Transistor 41 performs the function of subtracting the currents one from the other, flowing in the two circuits already described. That is to say, the current $I_1$ flowing in the first circuit part is substracted from the current $I_2$ flowing through the resistor 46. The base of transistor 41 is connected to the junction of the diodes 42 and 43, its emitter to terminal G, and its collector to the junction of the resistor 46 and the diode 44. Thus, since the diode 42 and the transistor 41 form a current mirror circuit, if the base common current amplification factor of the transistor 41 is taken as 1, its collector current $I_C$ is then equal to $I_1$. Consequently, the current I through the diode 44 is $$\begin{aligned} I &= I_2 - I_1 \\ &= \frac{V_{CC} - V_F}{R_{46}} - \frac{V_{CC} - 2V_F}{R_{45}} \end{aligned} \tag{7}$$

with the following result, that if $R_{45} = R_{46} = R$, $$I = V_F/R \tag{8}$$

FIG. 4(B) shows the case where diode-connected transistors have been substituted for the diodes in the circuit of FIG. 4(A), a current mirror circuit is formed by the diode-connected transistor 44 (corresponding to the diode 44) and the transistor 44-1, and output current $I_{out}$ is obtained from transistor 44-1.

In this circuit, $I_{out}$ is equal to the collector current of transistor 44, i.e. to the current I through the diode 44 in FIG. 4(A). The voltage-current properties of this circuit are as shown in FIG. 4(C).

When the power supply voltage $V_{CC}$ is more than the second voltage $V_2$ ($V_F$ or $V_{BE}$, the voltage between the base and emitter of the transistor), the output current $I_{out}$ is a function of the power supply voltage - that is the current is expressed in formula (6). When the voltage exceeds the first voltage $V_1$ ($2V_F$ or $2V_{BE}$), the output current is supplied as the constant-current expressed by formula (8). This is shown in FIG. (*c*).

In the circuit of FIG. 4(D) the value of the output current $I_{out}$ is smaller than that of the current through the transistor 44 because of the resistor 47 connected between the emitter of the transistor 44-1 and the power terminal G.

Figure 4E:
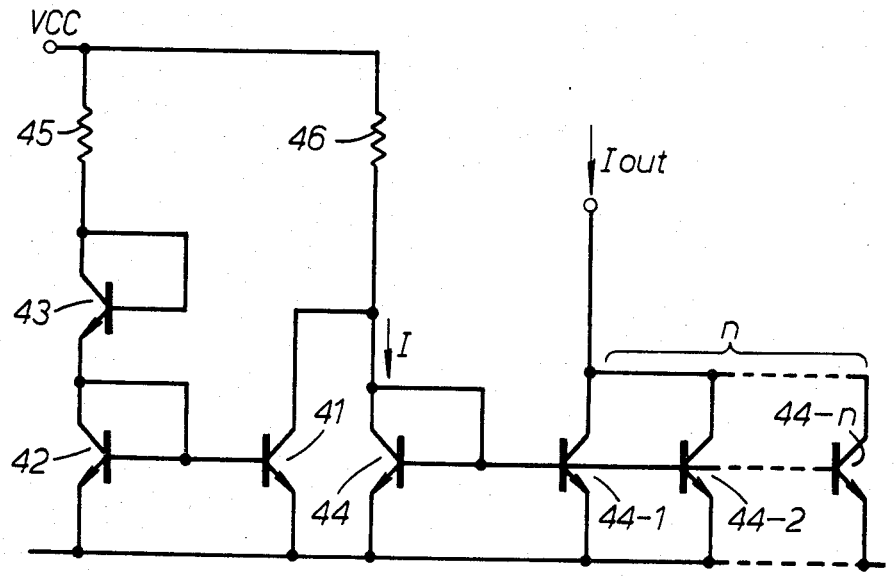

In FIG. 4(E), conversely, the intention is to obtain an output current $I_{out}$ larger than I. The transistors 44-1~44-n are provided to form n current mirror circuits with the transistor 44; the bases, emitters and collectors of these transistors 44-1~44-n are respectively commonly connected together, and $I_{out}$ is obtained from the common collector terminal.

Consequently, if the structural dimensions of the transistor 44 and the transistors 44-1~44-n are made identical, a current of n times the current through the transistor 44 is obtained as $I_{out}$.

Figure 1A:
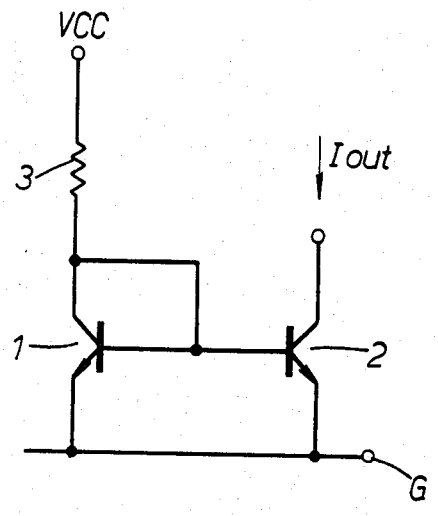
FIG. 1(A) PRIOR ART
FIG. 1(A) is a circuit diagram of a conventional current source.
Figure 1B:
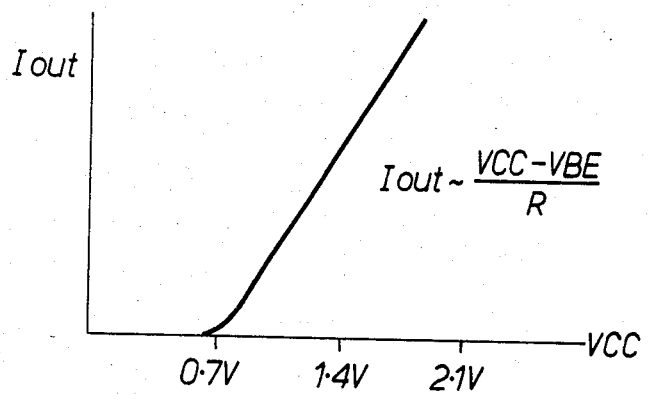
FIG. 1(B) is the voltage-current characteristic thereof.
Figure 2A:
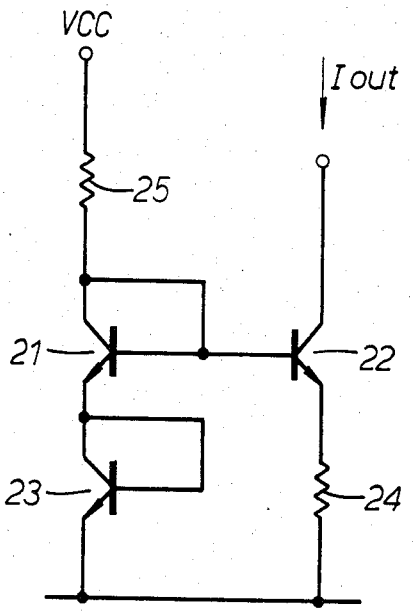
FIG. 2(A) PRIOR ART
FIGS. 2(A) and (B) are circuit diagrams of other conventional current sources.
Figure 2B:
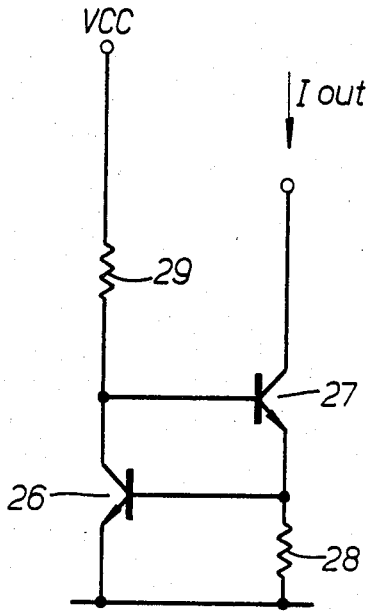
FIG. 2(B) PRIOR ART
FIG. 2(C) is the voltage-current characteristic for them.
FIG. 2(D) is a circuit diagram of a CML circuit using the circuit illustrated in FIG. 2(A) as its current source.
Figure 2C:
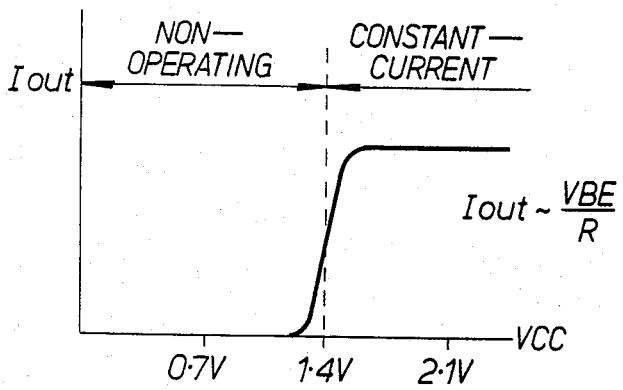
Figure 2D:
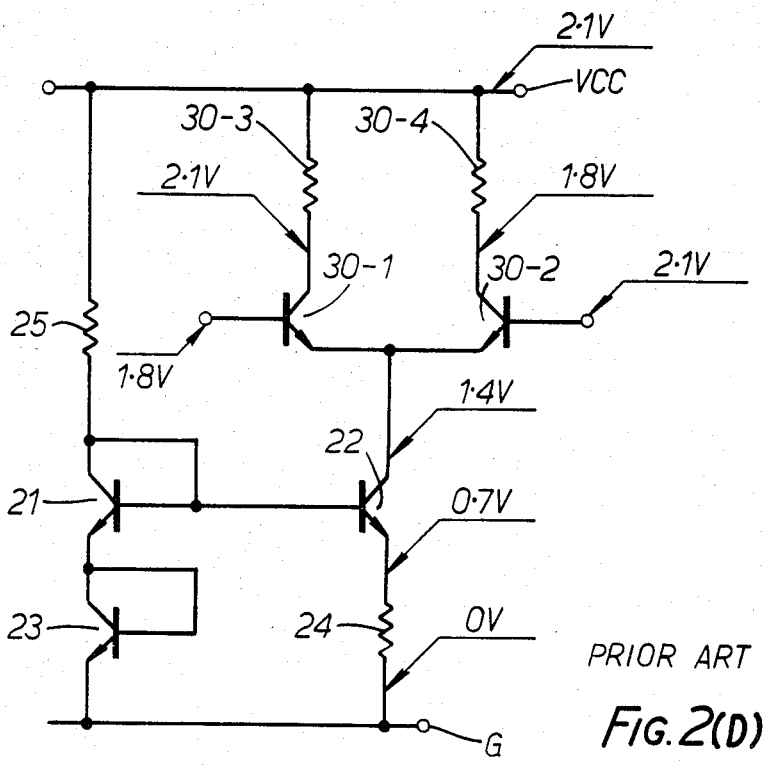
PRIOR ART FIG. 2(D)
Figure 3:
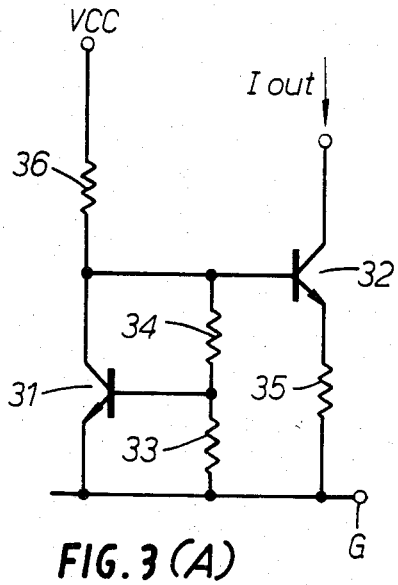
FIG. 3 (A) PRIOR ART
FIG. 3(A) is a circuit diagram of another conventional current source.
FIG. 3(B) is the voltage-current characteristic thereof.
Figure 3B:
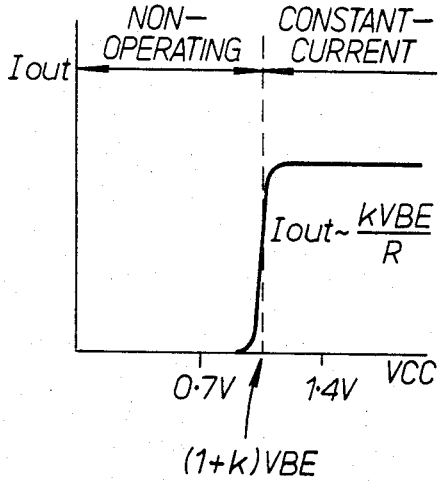
Figure 5A:
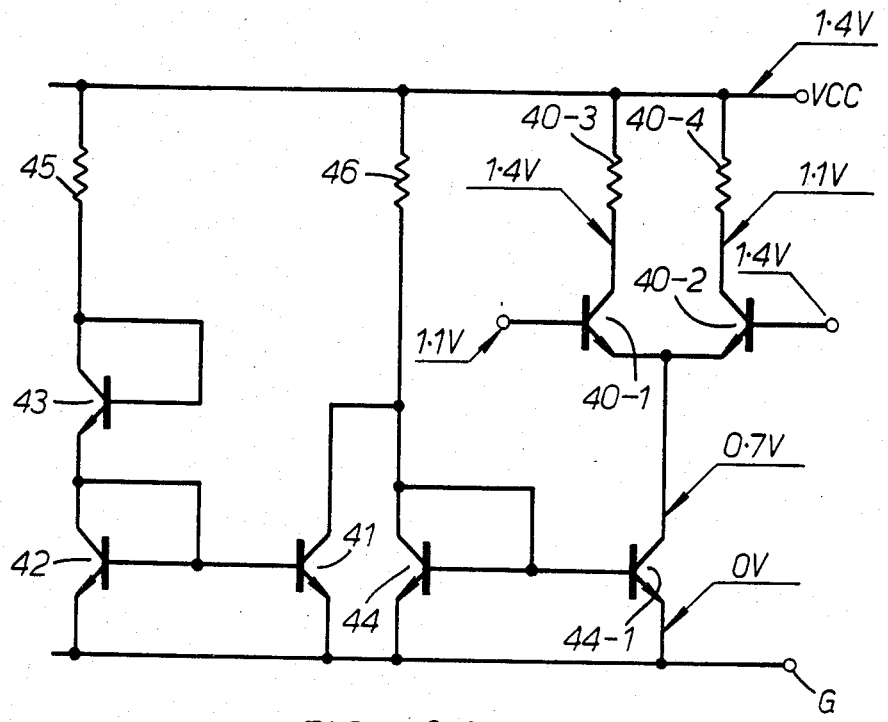
FIGS. 5(A) and (B) show applications of the transistor circuit according to the present invention to CML circuits.

FIG. 5(A) shows an example of a circuit in which the transistor circuit of this invention is applied to the current source of a CML circuit. Using the current source circuit shown in FIG. 4(B), the commonly connected emitters of the transistors 40-1 and 40-2 are connected to the collection of transistor 44-1. In this circuit, as previously explained, the electric potential of the collector of transistor 44 must be greater than $V_{BE}$ of the transistor, i.e. more than 0.7 V for current to be available at the collector of the transistor 44-1. Consequently, for the CML circuit to function, it is sufficient if an input voltage of approximately 1.4 V is impressed on the bases of the transistors 40-1 and 40-2, and if a similar voltage is applied to the collectors. Compared with the requirement for a supply voltage of at least 2.1 V in the conventional circuit of FIG. 2(D), therefore, this circuit can operate at a much lower voltage.

Figure 5B:
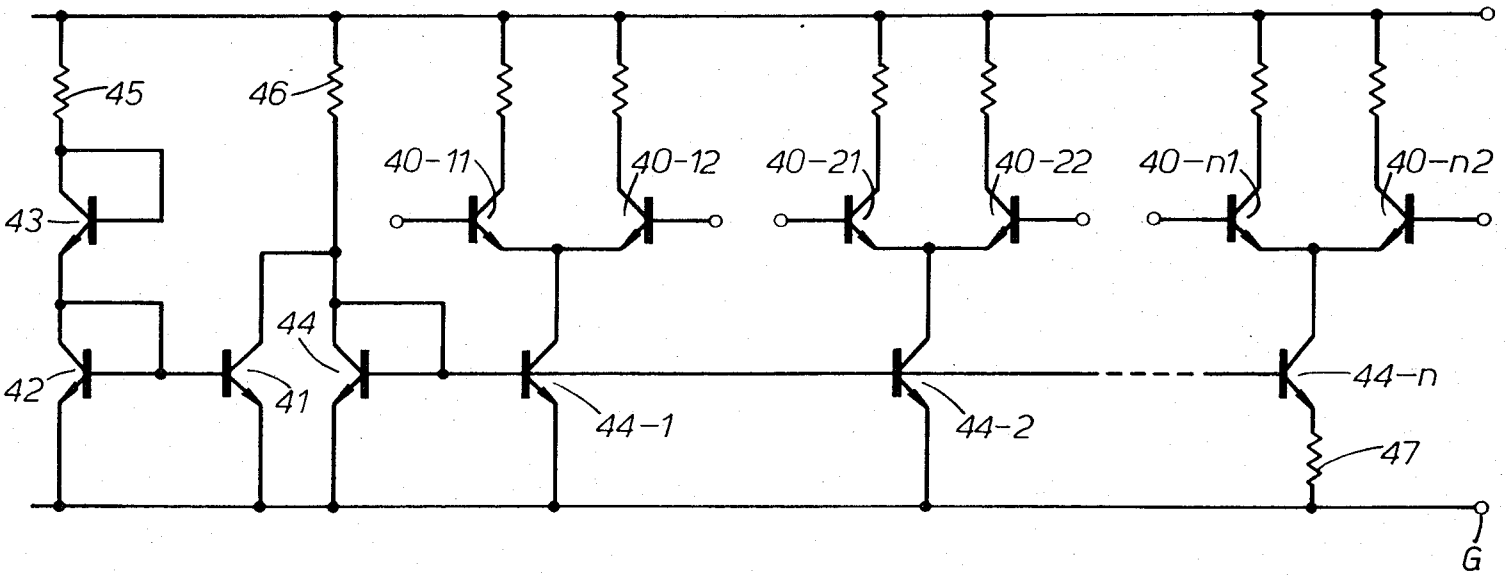

FIG. 5(B) shows an embodiment involving a CML layout in several (n) stages. The resistor 47 connected at the nth stage between the transistor 44-n and the terminal G is for current setting.

Figure 6:
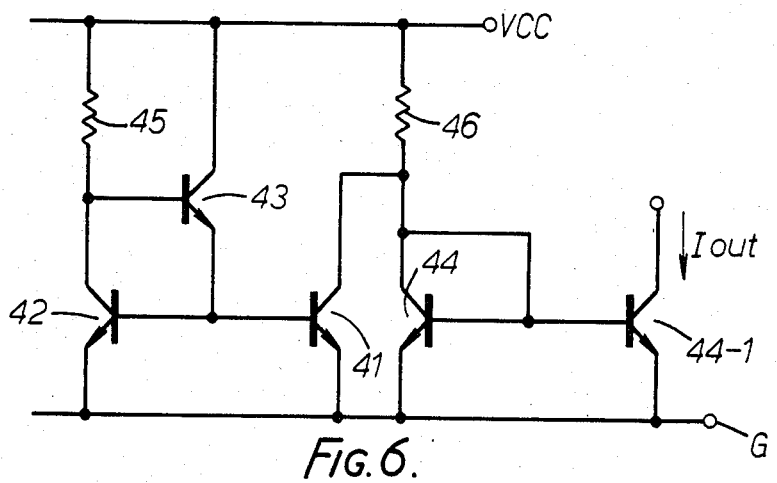
FIG. 6 is a circuit diagram of a further, fifth embodiment according to the present invention.

FIG. 6 is a circuit diagram of another embodiment of the invention. The base and collector of transistor 42 are connected together via the base-emitter junction of transistor 43. The aim here, in contrast to an embodiment such as that illustrated in FIG. 4(B), where the base and collector of the transistor 42 are directly connected, is that the current flowing from the collector of the transistor 42 to the junction of the bases of the transistors 41 and 42 should be multiplied by $(1-\alpha)$, and that the collector currents of these two transistors should be matched more closely. In this embodiment, a constant-current is obtained from the collector of the transistor 44-1 when the electric potential of the base of the transistor 43' is at least $2V_{BE}$.

Figure 7A:
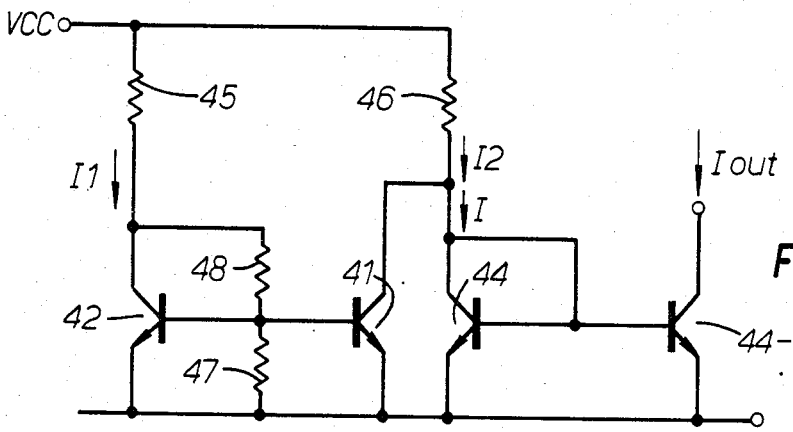
FIG. 7(A) is a circuit diagram of a sixth embodiment according to the present invention.

FIG. 7(A) is a circuit diagram showing another embodiment of the invention. It shows an example of a circuit in which the threshold value of the power supply voltage for the supply of a constant-current is $(1+k)V_{BE}$. The bases of the transistors 41 and 42 are connected in common and are biased by resistors 47 and 48 connected in series between the collector of the transistor 42 and the power supply terminal G. Therefore when the voltage drop across the resistor 47 is greater than $V_{BE}$ of the transistor, the transistor is placed in a conducting state. If the resistances of the resistors 47 and 48 at this point are taken as $R_{48}=k\cdot R_{47}$ (where $R_{47}$ and $R_{48}$ are the resistances of the resistors 47 and 48 respectively, and k is an arbitrary constant), the electric potential of the collector of transistor 42 is $(1+K)V_{BE}$. The current $I_1$ flowing through the resistor 45 is therefore as follows.

$$I_1 = \frac{V_{CC} - (1+k)V_{BE}}{R_{45}} \tag{9}$$

Further, when the electric potential on the collector of transistor 44 is greater than $V_{BE}$, the current $I_2$ flowing through the resistor 42 has a value which is a function of the power supply voltage $V_{CC}$, and can be expressed as follows.

$$I_2 = \frac{V_{CC} - V_{BE}}{R_{46}} \tag{10}$$

where $R_{45}$ and $R_{46}$ are the resistances of the resistors 45 and 46.)

Consequently, the collector current of transistor 44, and therefore the output current $I_{out}$, is as follows.

$$I_{out} = I_2 - I_1 = \frac{V_{CC} - V_{BE}}{R_{46}} - \frac{V_{CC} - (1+k)V_{BE}}{R_{45}} \tag{11}$$

Here, if $R_{45}=R_{46}=R$, formula (11) can be expressed as follows.

$$I_{out}=kV_{BE}/R \tag{12}$$

Figure 7B:
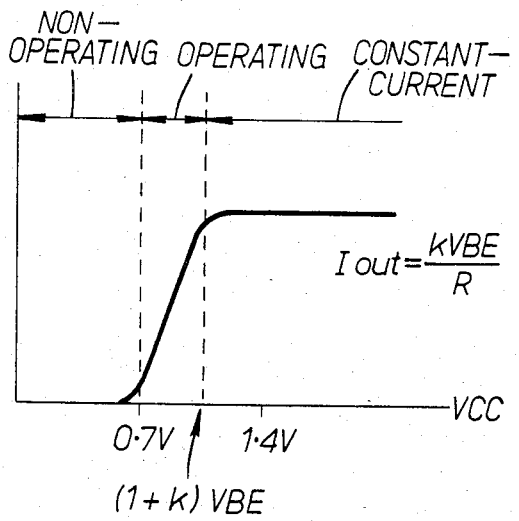
FIG. 7(B) shows the voltage-current characteristics thereof.

Consequently, the relation between the output current $I_{out}$ and the power source voltage $V_{CC}$ is as shown in FIG. 7(B). When the power supply voltage $V_{CC}$ is more than $V_{BE}$ of the transistor (approximately 0.7V), an output current $I_{out}$ which is a function of the power supply voltage begins to flow; when $V_{CC}$ exceeds $(1+k)V_{BE}$, $I_{out}$ becomes constant and is expressed as $kV_{BE}/R$.

Figure 8A:
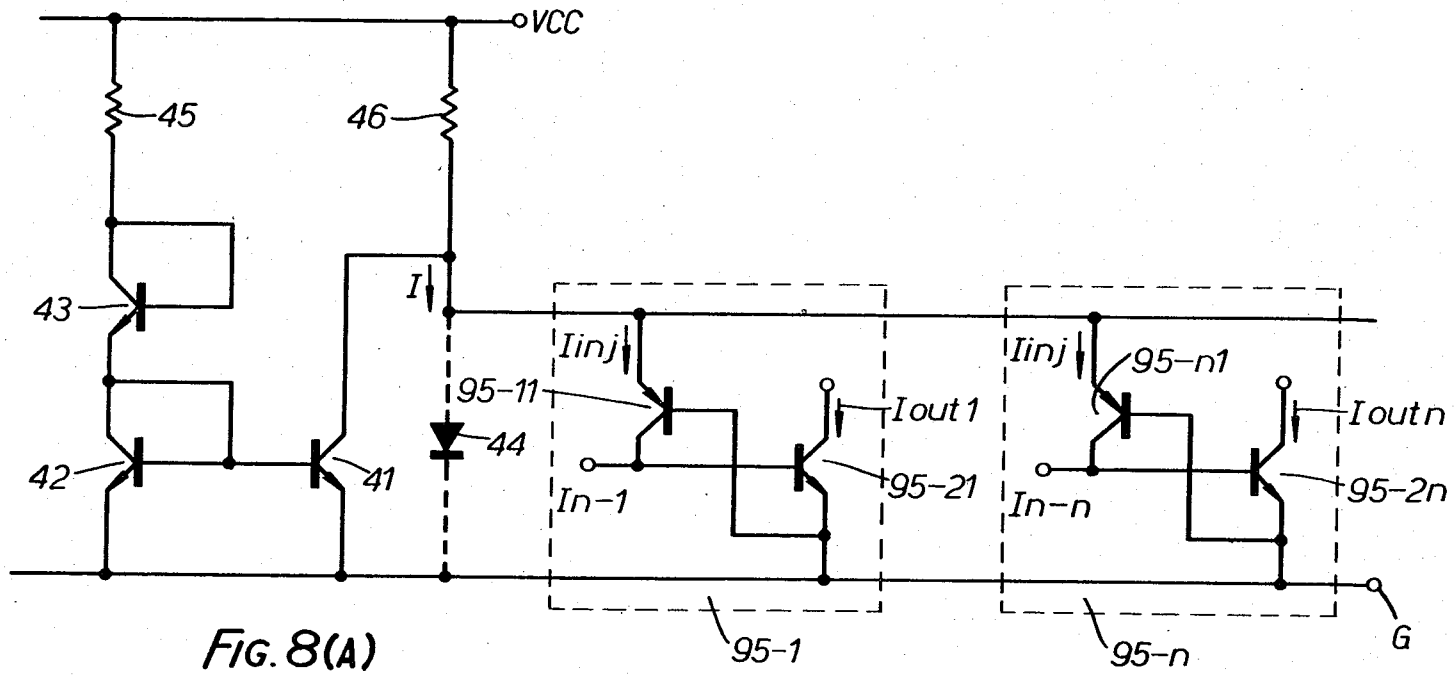
FIG. 8(A) is a circuit diagram of a seventh embodiment of a transistor circuit according to the present invention.

FIG. 8(A) is a circuit diagram showing an embodiment in which the constant current obtained by the transistor circuit of this invention is used as an injection current in $I^2L$ circuits. In the diagram, $nI^2L$ circuit stages from 95-1 to 95-n are connected between the collector of the transistor 41 and the power supply terminal G. Each $I^2L$ circuit consists of an injection transistor 95-11~95-n1 and an output transistor 95-21~95-2n; inputs $I_{n-1}$~$I_{n-n}$ *are applied at the bases of the output transistor* 95-21~95-2*n*.

In this circuit layout, a virtual diode 44, derived from the base - emitter junctions of the injection transistors of the $I^2L$ circuits is connected between the collector and emitter of the transistor 41.

Consequently, the operation of the circuit as a constantcurrent source circuit is similar to what occurs in the basic circuit layout explained above with reference to FIG. 4(A). The only difference is that when $nI^2L$ circuits are connected, the injection current $I_{inj}$ for each $I^2L$ circuit is as follows.

$$I_{inj}=V_{BE}/n.R \tag{13}$$

When the transistor circuit of this invention is used in this way, the power source threshold is a low voltage (approximately 0.7 V), and a constant injection current is obtained when the power supply voltage is equal to $2V_{BE}$ (approximately 1.4 V) or higher.

Figure 8B:
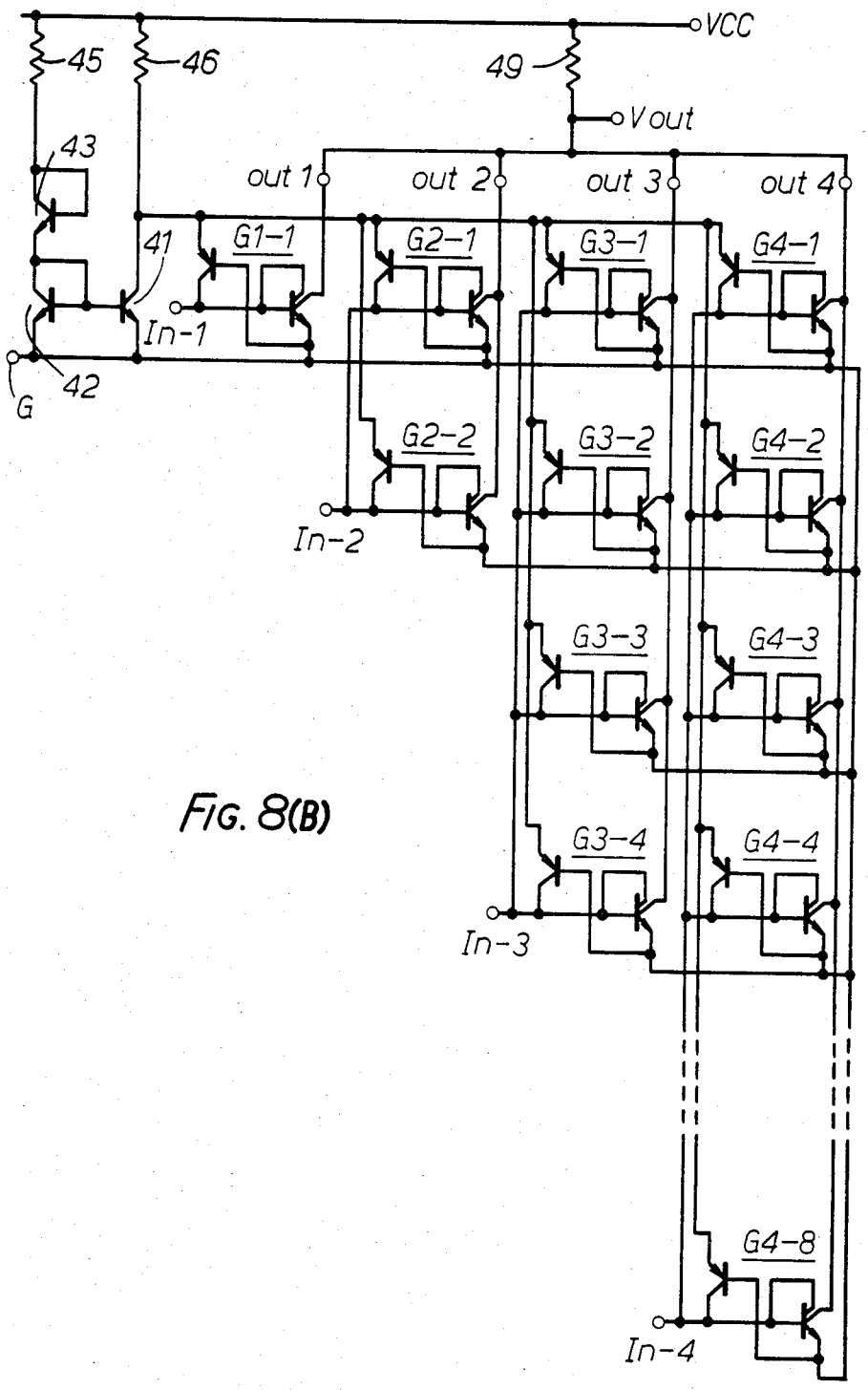
FIG. 8(B) shows an application of the transistor circuit illustrated in FIG. 8(A).

FIG. 8(B) is a circuit diagram of an embodiment applied to a 4 bit D/A converter made up of $I^2L$ circuits using the present invention source. $I_{n-1}$ is the least significant bit (LSB) input, and $I_{n-4}$ the most significant bit (MSB) input. The input $I_{n-1}$ is the input to a stage consisting of a single $I^2L$ circuit $G_{1-1}$, $I_{n-2}$ to a stage consisting of two $I^2L$ circuits $G_{2-l} \sim G_{2-2}$, $I_{n-3}$ to a stage consisting of four $I^2$ circuits $G_{3-1} \sim G_{3-4}$, and $In_{n-4}$ to a stage consisting of eight $I^2L$ circuits $G_{4-1} \sim G_{4-8}$. The outputs of the respective $I^2L$ circuits are connected in common to the output terminals $Out_1$, $Out_2$, $Out_3$, and $Out_4$. These output terminals are further connected in common via a load resistor 49 to the power supply terminal $V_{CC}$. In this circuit layout, when any input is at the logic level '1', the output transistor (or transistors) of the corresponding $I^2L$ circuit stage turns ON, and output current is obtained weighted by the number of $I^2L$ circuits turned ON, in response to the respective inputs. The voltage drop across the resistor 49 developed by the sum of these output currents is obtained as an analog output.

In this circuit layout too the device becomes operational at a low voltage (approximately 0.7 V), and at and above 1.4 V a constant injection current is supplied to each $I^2L$ circuit. The injection current $I_{inj}$ for each $I^2L$ circuit under constant-current operation is indicated in this case by $$I_{inj} = V_{BE}/15.R \tag{14}$$

where R is the resistance of the resistors 45 and 46.

Figure 9:
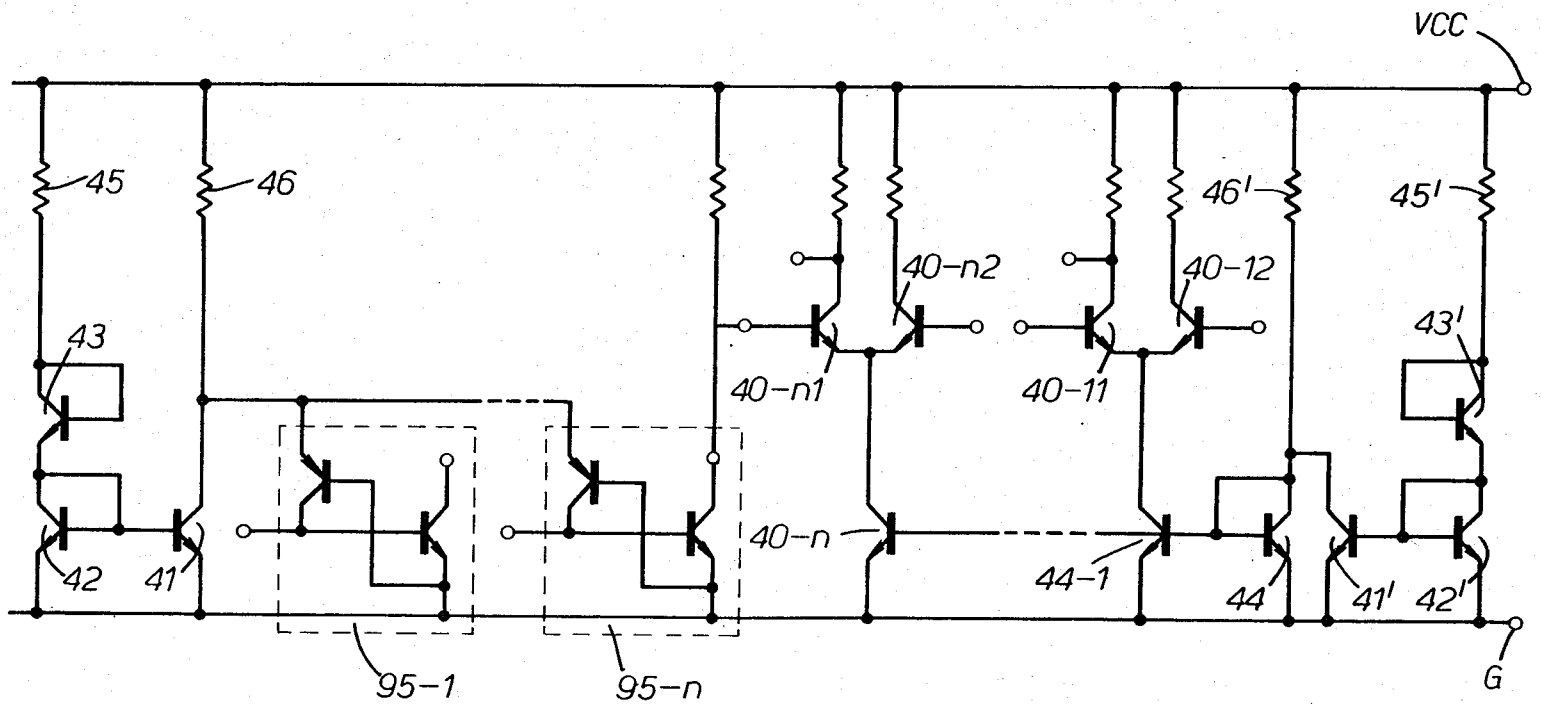
FIG. 9 shows an application of the transistor circuit illustrated in FIGS. 4(B) and 8(A).

FIG. 9 is a circuit diagram of an embodiment which combines the layouts of FIGS. 5 and 8. In this circuit too a CML circuit is provided which will operate at a low voltage. A first transistor circuit of this invention is used as the means of supplying injection current for the $I^2L$ circuits, and a second transistor circuit (identified by the same numbers with prime) as the current source for the CML circuit. Further description of the operation of this circuit is not required since it operates as described above for the similar corresponding circuits.

Figure 10:
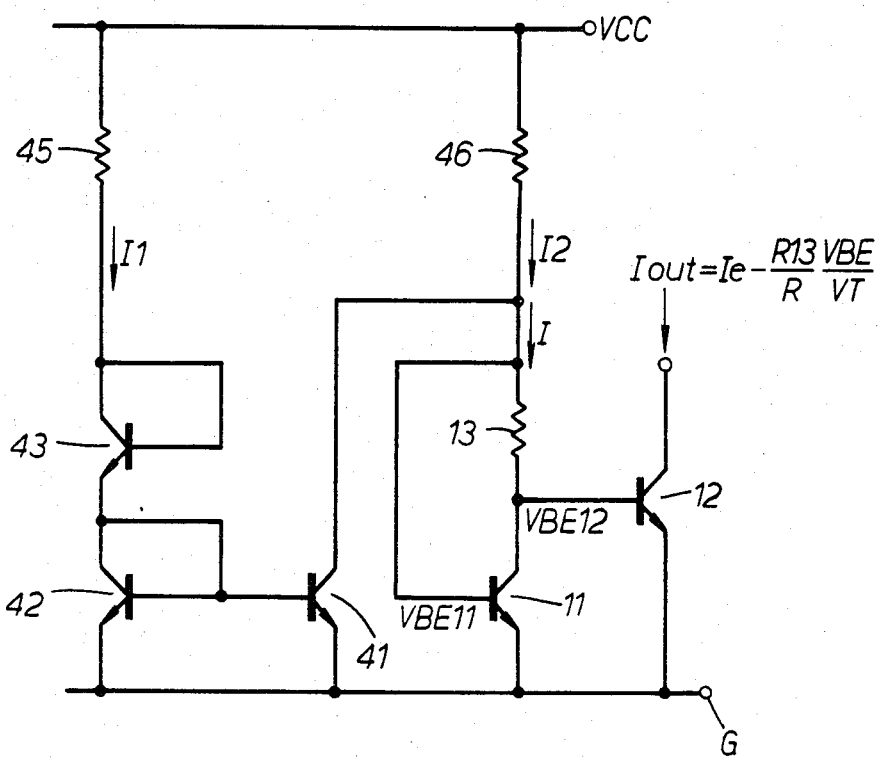
FIG. 10 is a circuit diagram of an eighth embodiment according to the present invention.

FIG. 10 is a circuit diagram of another embodiment of the invention, designed to obtain a micro-current. The difference in layout from the embodiment of FIG. 4(B) is the circuit connected between the collector of the transistor 41 and the power supply G.

This circuit consists of two transistors 11 and 12, with their respective emitters connected to the power supply terminal G. The base of the transistor 11 is connected to the collector of the transistor 41, and the resistor 13 is connected between the base and the collector of the transistor 11. The base of transistor 12 is connected to the collector of transistor 11, and the collector of the transistor 12 constitutes the output terminal of the circuit.

The output current $I_{out}$ in this diagram is found in the following manner. If $V_{BE11}$ and $V_{BE12}$ are the respective voltages between the base and emitter of the transistors 11 and 12, while $R_{13}$ is the resistance of the resistor 13, and I the current through it, the following formula results.

$$V_{BE12} = V_{BE11} - R_{13}.I\ R_{13}I \tag{15}$$

Further, the current $I_1$ through the resistor 45 is found as follows:

$$I_1 = \frac{V_{CC} - (V_{BE42} + V_{BE43})}{R_{45}} \tag{16}$$

where $V_{BE42}$ and $V_{BE43}$ are the voltages between base and emitter of the transistors 42 and 43, and $R_{45}$ is the resistance of the resistor 45.

Further, the current $I_2$ flowing through the resistor 46 is expressed as follows:

$$I_2 = \frac{V_{CC} - V_{BE11}}{R_{46}} \tag{17}$$

where $R_{46}$ is the resistance of the resistor 46, and $V_{BE11}$ the voltage between base and emitter of transistor 11.

Consequently, since the current I consists of the current which is the difference between $I_1$ and $I_2$, $$I = I_2 - I_1 = \frac{V_{CC} - V_{BE11}}{R_{46}} - \frac{V_{CC} - (V_{BE42} + V_{BE43})}{R_{45}} \tag{18}$$

where $R_{45} = R_{46} = R$, and $V_{BE11} = V_{BE42} = V_{BE43} = V_{BE}$, which gives the following.

$$I = V_{BE}/R \tag{19}$$

Further, the base-emitter voltages $V_{BE11}$ and $V_{BE12}$ of the transistors 11 and 12 are expressed as follows:

$$V_{BE11} = \frac{kT}{q} \ln \frac{I}{I_s} \tag{20}$$

$$V_{BE12} = \frac{kT}{q} \ln \frac{I}{I_s} - \frac{R_{13}}{R} \cdot V_{BE} \tag{21}$$

where q is the amount of electric charge of one electron, k is the Boltzmann constant, T is the absolute temperature, and $I_s$ is the saturation current.

If the base-emitter voltage $V_{BE12}$ of the transistor 12 is expressed in terms of the output current $I_{out}$, we have $$V_{BE12} = \frac{kT}{q} \ln \frac{I_{out}}{I_s} \tag{22}$$

which gives, from formulae (20) and (21), $$\frac{kT}{q} \ln \frac{I_{out}}{I_s} = \frac{kT}{q} \ln \frac{I}{I_s} - \frac{R_{13}}{R} \cdot V_{BE} \tag{23}$$

leading, if this equation is solved, to $$I_{out} = I \cdot e - \frac{R_{13}}{R} \cdot \frac{V_{BE}}{V_T} \tag{24}$$

where $V_T = \frac{kT}{q}$ (thermovoltage).

Figure 11:
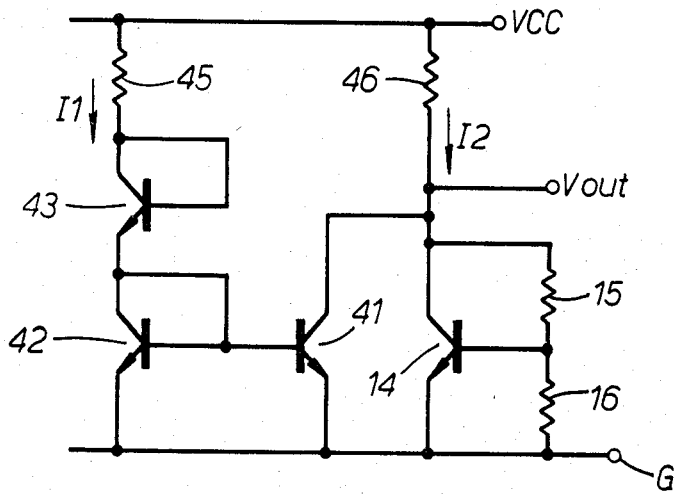
FIG. 11 is a circuit diagram of a ninth embodiment according to the present invention.

FIG. 11 is a circuit diagram showing an application of the transistor circuit of this invention to a constant-voltage source circuit. Transistor 14 is connected between the collector of transistor 41 and the power supply terminal G, its emitter being connected to the power supply terminal G and its collector to the collector of the transistor 41. Further, a series circuit consisting of resistors 15 and 16 is connected between the collector of transistor 14 and the power supply terminal G, the junction between them being connected to the base of the transistor 14. $R_{15}$ and $R_{16}$ are now taken as the resistances of the resistors 15 and 16 respectively, and it is postulated that $R_{15}=k \cdot R_{16}$, where k is an arbitrary constant.

$$R_{15}=k \cdot R_{16} \tag{25}$$

In this circuit of FIG. 11, collector current begins to flow in the transistor 14 when the voltage drop across the resistor 16 exceeds approximately 0.7 V.

If the base-emitter voltage of the transistor 14 is taken as $V_{BE14}$, the voltage between emitter and collector is expressed as $(1+k)V_{BE14}$. Consequently, the current $I_2$ flowing through the resistor 46 is expressed as follows:

$$I_2 = \frac{V_{CC} - (1 + k) \cdot V_{BE14}}{R_{46}} \tag{26}$$

while the current $I_1$ through the resistor 45, on the other hand, is expressed as follows:

$$I_1 = \frac{V_{CC} - (V_{BE42} + V_{BE43})}{R_{45}} \tag{27}$$

where $V_{BE42}$ and $V_{BE43}$ refer to the transistors 42 and 43. Consequently, assuming that $V_{BE42}=V_{BE43}=V_{BE14}=V_{BE}$, and that in the case of the resistances of the resistors 45 and 46, $R_{45}=R_{46}=R$, the collector current of the transistor 14, if the current flowing through the resistors 15 and 16 is ignored, is expressed by the following:

$$I = I_2 - I_1 \tag{28}$$

$$= \frac{(1 - k)V_{BE}}{R}$$

and a voltage (1+k) times the base-emitter voltage of the transistor 14, which is determined by the current I expressed by this formula (28), is obtained from the $V_{out}$ terminal connected to the collector of the transistor 41. The collector current of the transistor 14 is made constant at the value indicated by formula (28). Because $V_{BE}$ is stable, $V_{out}$ is stabilized at $V_{out}=(1+k) \cdot V_{BE}$.

Figure 12:
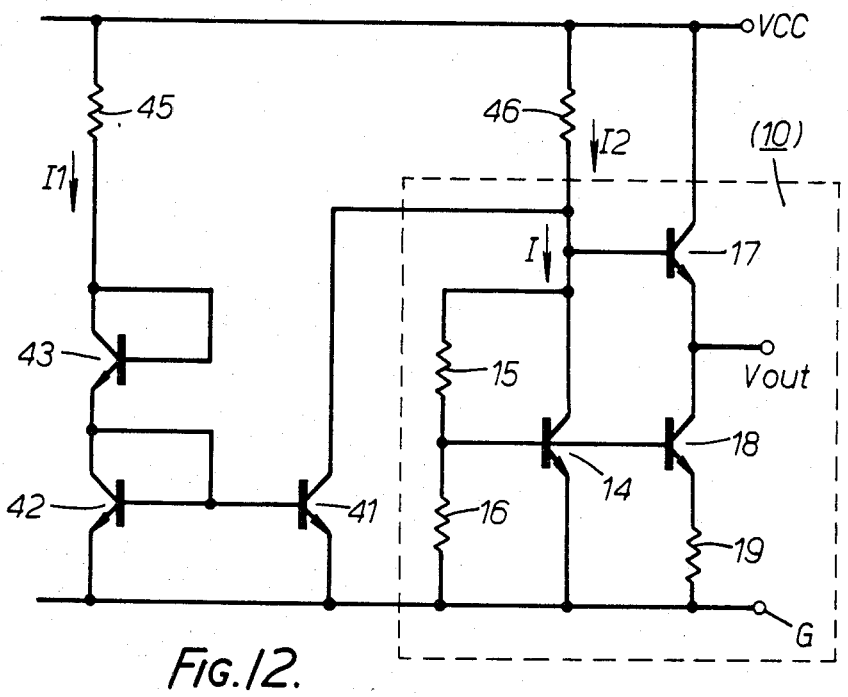
FIG. 12 is a circuit diagram of a tenth embodiment according to the present invention.

FIG. 12 is a circuit diagram showing another embodiment of the application of the invention to a constant-voltage source circuit. The circuit illustrated in the diagram is formed by providing the circuit shown in FIG. 11 with further transistors 17 and 18 and a further resistor 19. The collector of the transistor 17 is connected to the power supply terminal $V_{CC}$, its base to the collector of the transistor 41, and its emitter to the output terminal $V_{out}$. The collector of the transistor 18 is connected to the output terminal $V_{out}$; its base is connected in common to the base of the transistor 14, and its emitter is connected via resistor 19 to the power supply terminal G. The circuit portion 10 surrounded by the broken line is the subject of Japanese Patent Application No. 54-80099 by the inventor of the present invention. If we postulate that $_R=R_{15}/R_{16}$ ($R_{15}$ and $\alpha R_{16}$ being the resistance of the resistors 15 and 16), the supply of a constant current I makes it possible to provide a constant voltage source with output voltage $V_{out}$, at $\alpha_R$ time the energy gap voltage $V_{gO}$ of silicon at 0° K. and with a temperature coefficient of 0.

Figure 13:
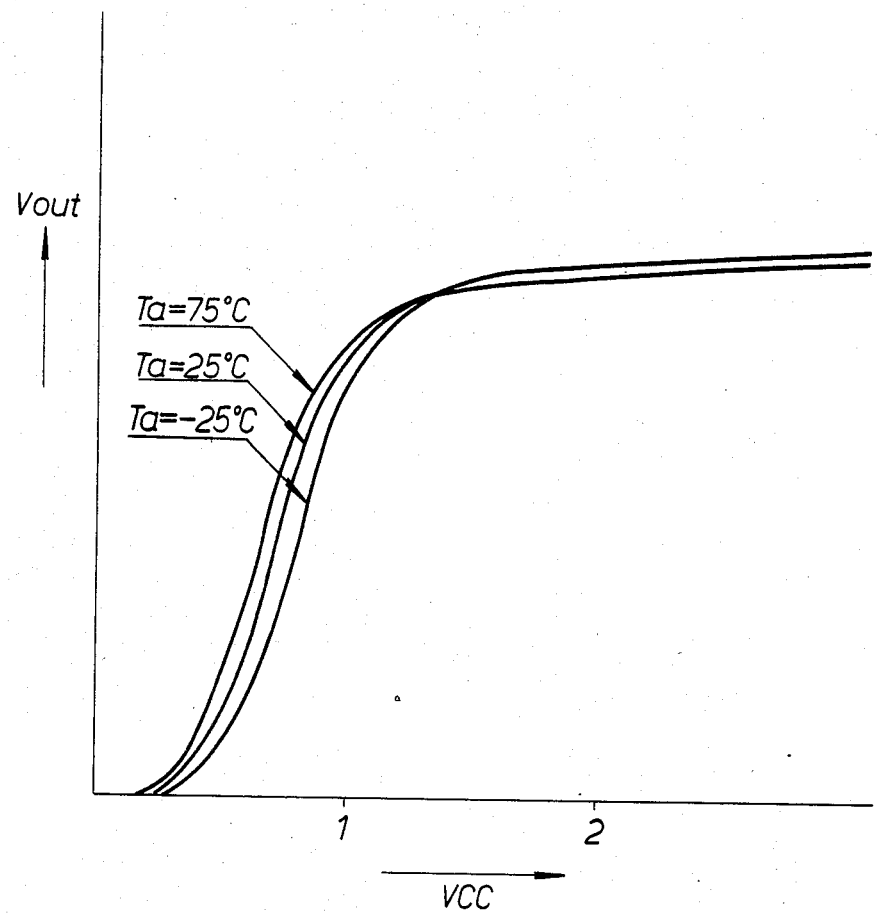
FIG. 13 shows an operation characteristic of the transistor circuit illustrated in FIG. 12.

FIG. 13 is a graph showing the results of experiments with the circuit illustrated in FIG. 12. It will be seen that when the power supply voltage exceeded 1.4 V, a virtually constant output voltage was supplied even when the temperature was varied.

Figure 14:
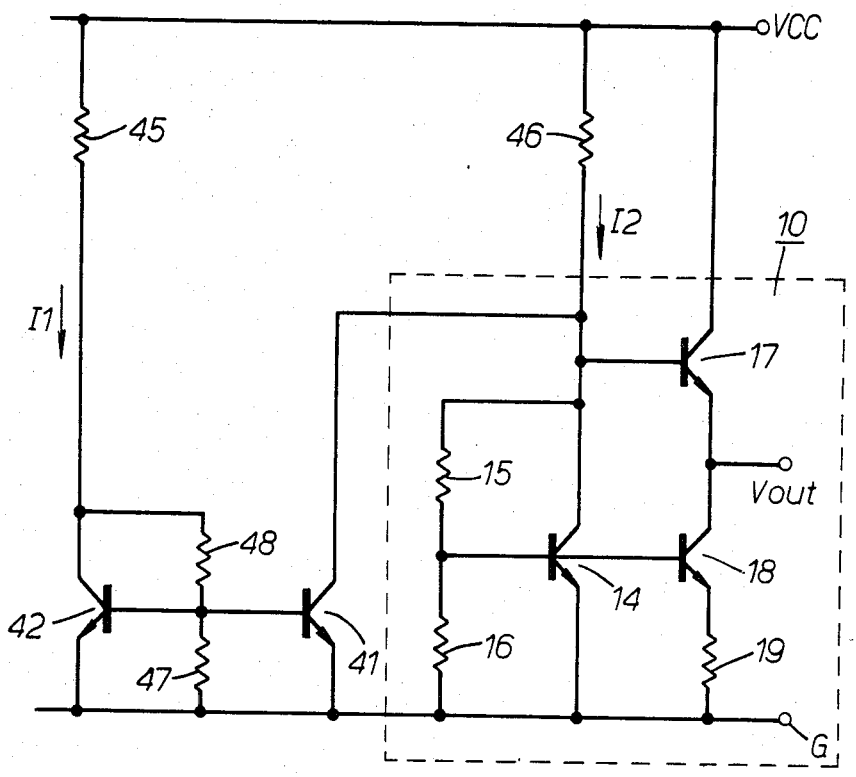
FIG. 14 is a circuit diagram of the eleventh embodiment according to the present invention.

FIG. 14 is a circuit diagram showing an embodiment consisting of another application of the invention as a constant-voltage source. The bases of the transistors 41 and 42 are biased by means of a series circuit consisting of the resistors 47 and 48. The effect is, as explained in connection with the embodiment illustrated in FIG. 7, to commence constant-voltage operation from a lower voltage. As explained above, this invention makes it possible for operation to start at a low power supply voltage (approximately 0.7 V); and since it can be used as a low-voltage, constant-current and constant-voltage source, the range of applications is extremely wide. Operation can be achieved with a single 1.5 V battery, for example, and this will greatly assist the miniaturization devices such as portable audio devices.

What is claimed is:

1. A transistor circuit having first and second terminals driven by a power supply voltage applied across the terminals comprising:

first and second circuit portions connected in parallel between said first and second terminals, said first and second circuit portions responsive to said power supply voltage to cause respective first and second currents proportional to said power supply voltage when said power supply voltage exceeds respective first and second predetermined voltage levels wherein said first circuit portion includes first, second and third resistor means connected in series between said first and said second terminal, first transistor means having an emitter electrode connected to said second terminal, a base electrode connected between said second and third resistor means, and a collector electrode connected between said first and second resistor means, said second circuit portion comprises fourth resistor means having first and second ends, said first end being connected to said first terminal, diode means connected in series between said second end of said fourth resistor means and said second terminal; and circuit means connected to said first and second circuit portions for producing a differential current of said first and second currents, said circuit means including second transistor means having an emitter electrode connected to said second terminal, a base electrode connected to said base electrode of said first transistor means, and a collector electrode connected to said second end of said fourth resistor means.

2. A transistor circuit having first and second terminals driven by a power supply voltage applied across the terminals comprising:

first and second circuit portions connected in parallel between said first and second terminals, said first and second circuit portions responsive to said power supply voltage to cause respective first and second currents proportional to said power supply voltage when said power supply voltage exceeds respective first and second predetermined voltage levels, wherein said first circuit portion includes first resistor means having first and second ends, said first end being connected to said first terminal, first and second diode means connected in series between said second end of said first resistor means and said second terminal, said second circuit portion comprises second resistor means having first and second ends, said first end being connected to said first terminal, third resistor means having first and second ends, said first end being connected to said second end of said second resistor means, first transistor means having an emitter electrode connected to said second terminal, a base electrode connected to said second end of said second resistor means, a collector electrode connected to said second end of said third resistor means, second transistor means having an emitter electrode connected to said second terminal, a base electrode connected to said second end of said third resistor means, a collector electrode connected to an output terminal; and circuit means connected to said first and second circuit portions for producing a differential current of said first and second currents.

3. A transistor circuit having first and second terminals driven by a power supply voltage applied across the terminals comprising:

first and second circuit portions connected in parallel between said first and second terminals, said first and second circuit portions responsive to said supply voltage to cause respective first and second currents proportional to said power supply voltage when said power supply voltage exceeds respective first and second predetermined voltage levels, wherein said first circuit portion comprises first resistor means having first and second ends, said first end being connected to said first terminal, first and second diode means connected in series between said second end of said first resistor means and said second terminal, said second circuit portion comprises second, third and fourth resistor means connected in series between said first and second terminals, first transistor means having an emitter electrode connected to said second terminal, a base electrode connected to a connection of said third and fourth resistor means, and a collector electrode connected between said second and third resistor means; and circuit means connected to said first and second circuit portions for producing a differential current of said first and second currents, said circuit means including second transistor means having an emitter electrode connected to said second terminal, a base electrode connected between said first and second diode means, and a collector electrode connected to said collector electrode of said first transistor means.

4. A transistor circuit according to claim 2, which further comprises third transistor means having an emitter electrode connected to an output terminal, a base electrode connected to the collector electrode of said first transistor means, a collector electrode connected to said first terminal, fourth transistor means having an emitter electrode connected to said second terminal, a base electrode connected to said base electrode of said first transistor means, a collector electrode connected to said emitter electrode of said third transistor means.

* * * * *